United States Patent [19]

Heffley, Jr.

[11] 4,045,023

[45] Aug. 30, 1977

[54] GAME APPARATUS

[76] Inventor: Russell H. Heffley, Jr., 1533 Lochinvar Drive, Fort Wayne, Ind. 46825

[21] Appl. No.: 530,742

[22] Filed: Dec. 9, 1974

Related U.S. Application Data

[62] Division of Ser. No. 405,575, Oct. 11, 1973, Pat. No. 3,897,947.

[51] Int. Cl.[2] ..... A63B 69/36

[52] U.S. Cl. ..... 273/35 B; 273/176 K

[58] Field of Search ..... 273/176 R, 176 A, 182 A, 273/182 R, 184 R, 185 R, 35 R, 35 B, 176 K

[56] References Cited

U.S. PATENT DOCUMENTS

| | | | |
|---|---|---|---|
| 1,660,339 | 2/1928 | Kaufmann | 273/182 A |
| 2,248,053 | 7/1941 | Bales | 273/176 A |
| 3,314,679 | 4/1967 | Kolln | 273/176 A |
| 3,599,980 | 8/1971 | Harmond | 273/176 A |
| 3,602,506 | 8/1971 | Gentiluomo | 273/182 R |
| 3,738,664 | 6/1973 | Peeples | 273/176 A |
| 3,826,501 | 7/1974 | Hiromachi | 273/184 R |
| 3,861,680 | 1/1975 | Mowrer | 273/182 R |

*Primary Examiner*—George J. Marlo

[57] ABSTRACT

A game apparatus comprising a target with a plurality of target zones each of which is operatively connected to an impact responsive signal generator, a signal selecting circuit and a scoreboard by which objects impacting upon the target produce signals above an adjustable level that will register on the scoreboard. In a specific embodiment, the target may take the form of a simulated golf green and is combined with an all-weather golf driving range including a driving booth in which the environment is controlled, a fairway designed such that snow removal and ball retrieval are enhanced, and a device for registering the longer drives.

8 Claims, 16 Drawing Figures

GAME APPARATUS

This application is a divisional of U.S. application Ser. No. 405,575, filed Oct. 11, 1973, now U.S. Pat. No. 3,897,947.

BACKGROUND OF THE INVENTION

1. Field of the Invention

The present invention relates generally to game apparatus and targets, and more particularly, to targets in combination with electronic circuitry and a scoreboard by which impacts on the target will register on the scoreboards, and still more particularly, to such targets, circuitry, and scoreboards in combination with an all-weather golf driving range, a fairway enhancing snow removal and ball retrieval, driving booths in which the environment is controlled, and means for registering the longer drives.

2. Description of the Prior Art

Several driving range structures have heretofore been proposed which have devices for the collection of the golf balls and/or the return thereof to the tee area. These structures have included nets, sloping surfaces, and the like. Additionally, enclosed tee areas provided with heaters have been used in conjunction with driving ranges. Still, it is desirable to provide an all-weather driving range construction having improved means by which the balls are collected and returned to the tee area, means for removing from the fairway surface snow, ice and the like, and an improved driving booth in which the environment can be controlled in both summer and winter. It is highly desirable such a structure be relatively simple in construction and economical to build.

There have also been a variety of targets proposed. Some of these targets are useful as driving range golf greens. However, none of these targets are combined with a scoreboard and impact responsive devices by which the scoreboard registers a score in response to an impact on the target. Such targets when used as golf greens are susceptible to a plurality of impacts by a single ball resulting from the ball bouncing on the green. It is therefore highly desirable to provide not only a target having impact responsive devices and means for driving a scoreboard, but such a target equipped with signal selecting circuitry whereby only one signal is generated by any one ball impacting on the target and the remaining bounces of the ball on the green are not recorded on the scoreboard.

It is further highly desirable to provide a driving range structure incorporating the greens above-described and an electronic golf game by which competing players may accumulate a score. Such would enhance the interest in golf.

SUMMARY OF THE INVENTION

It is therefore a primary oject of the invention to provide an improved driving range structure.

It is another primary object of the invention to provide an improved target and scoreboard combination.

Another primary object of this invention is to provide an improved driving range structure having tees in a controlled environment.

It is another object to provide an improved scoreboard and target combination, the target of which is provided with impact-responsive signal generators and a signal selector circuit whereby only the signal in response to impacts of a predetermined magnitude are registered on the scoreboard.

Another object is to provide an improved target which is especially desirable as a golf green.

It is yet another object of this invention to provide an improved driving range structure which includes means by which snow and ice removal from the fairway thereof and ball collection and return thereof to the tee area are enhanced.

Another primary object of the invention is to provide registration of the distance a ball is driven from the tee.

It is still further an object of the invention to provide an improved driving range having one or more target greens connected to a scoreboard which registers golf balls impacting upon the green and accumulates the score of a person using the driving range.

BRIEF DESCRIPTION OF THE DRAWINGS

The above-mentioned and other features and objects of this invention and the manner of attaining them will become more apparent and the invention itself will be best understood by reference to the following description of an embodiment of the invention taken in conjunction with the accompanying drawings, wherein.

DESCRIPTION OF A SPECIFIC EMBODIMENT

Figure 1:
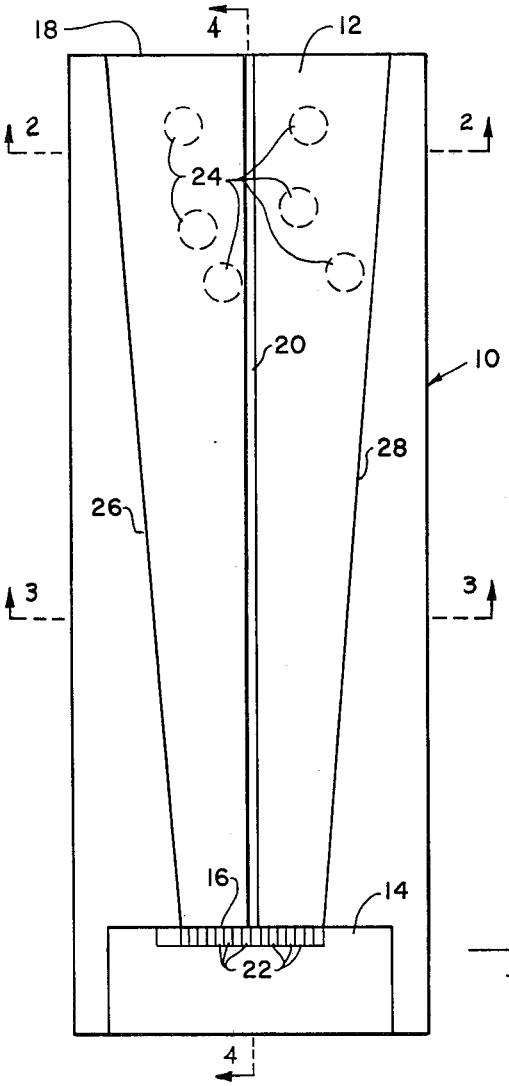
FIG. 1 is a top plan view of a driving range complex incorporating the invention.

Referring now to the drawings and more specifically to FIGS. 1 through 5 there is shown the improved driving range structure of the invention. The driving range structure 10 includes an elongated fairway 12 and a clubhouse 14. The fairway 12 is shown to have opposite ends 16 and 18 and a centrally located ball-retrieving gutter or alley 20 extending between the opposite ends 16, 18 of the fairway 12. A plurality of individual driving booths 22 are positioned side by side so as to extend across the fairway 12 at end 16. In each of these booths there is positioned a golf tee; both the booths 22 and the tee will be described in more detail hereinafter.

Adjacent end 18 of the fairway 12 at various positions 24 (only some of the positions 24 are shown) is at least one target green. The target greens of the invention will also be described in more detail hereinafter.

The fairway 12 extends from the driving booths 22 between the opposite ends 16, 18 and between spaced apart opposite longitudinal fairway boundaries 26 and 28. As shown in FIG. 1 the fairway 12 is wider at end 18 than at end 16 such that the fairway 12 tapers outwardly from the driving booths 22 linearly between the opposite straight longitudinal boundaries 26 and 28.

Figure 5:
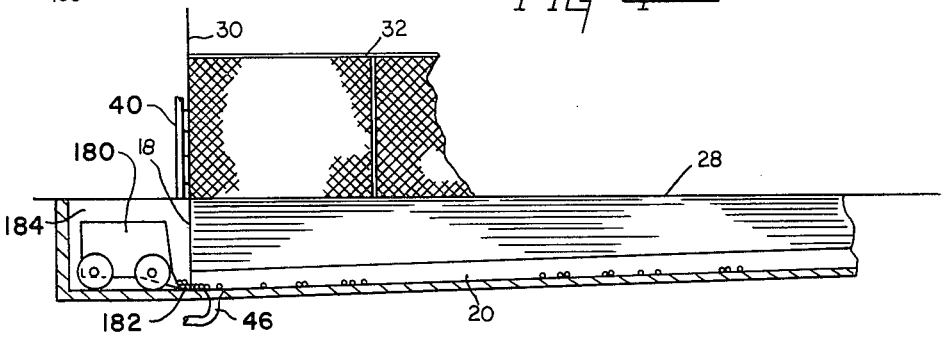
FIG. 5 is a fragmentary and enlarged sectional view of a portion of the driving range complex of the invention as illustrated in FIG. 4 particularly showing the mechanism by which the golf balls are returned to the tee area.

As is shown in FIGS. 2, 3, 4 and 5, end 18 is provided with a screen 30 and longitudinal boundaries 26, 28 are provided with screens 32. Screen 30 is approximately twice the height of screen 32 and has three independent sections 34, 36 and 38. Each of the sections 34, 36 and 38 extends horizontally across the end 18 and while supported one over the other by posts 40 as shown in FIG. 5, they are not connected to the adjacent sections. Each of the sections 34, 36 and 38 is connected to the posts 40 by a series of microswitches 154 (shown only in FIG. 12) which are normally open. Over screen 30 is mounted an electrically lighted yardage indicator 44. Each of the sections 34, 36 and 38 of the screen 30 is connected to the electronics shown in FIG. 12 and to the yardage indicator 44 in a manner so that a golf ball impacting on any one of the sections 34, 36 and 38 will appropriately light the yardage indicator 44. Impacts on section 38 will indicate 200 yards; impacts on section 36 will indicate 250 yards; and impacts on section 34 will indicate 300 yards. See FIGS. 2 and 3. The electronics shown in FIG. 12 will be described in detail hereinafter.

Figure 2:
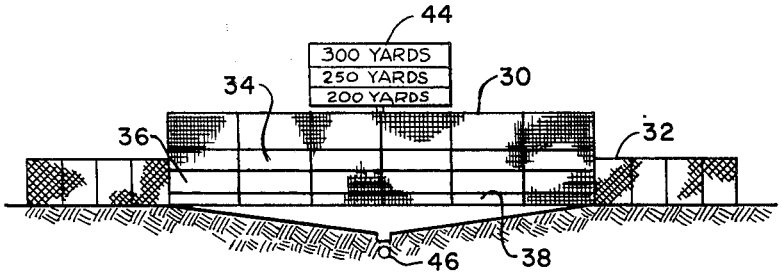
FIG. 2 is a sectional view of the driving range complex illustrated in FIG. 1 taken substantially along the section line 2—2 of FIG. 1.
Figure 3:
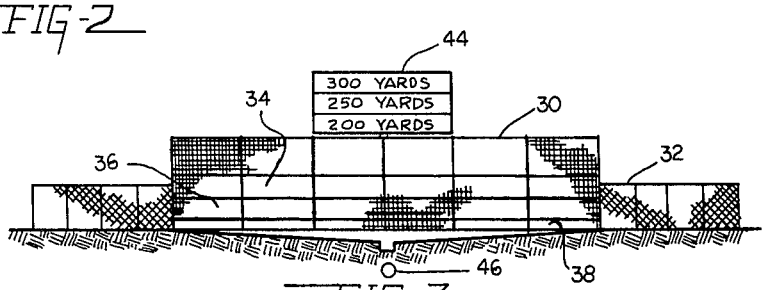
FIG. 3 is a sectional view of the driving range complex illustrated in FIGS. 1 and 2 taken substantially along the section line 3—3 of FIG. 1.
Figure 4:
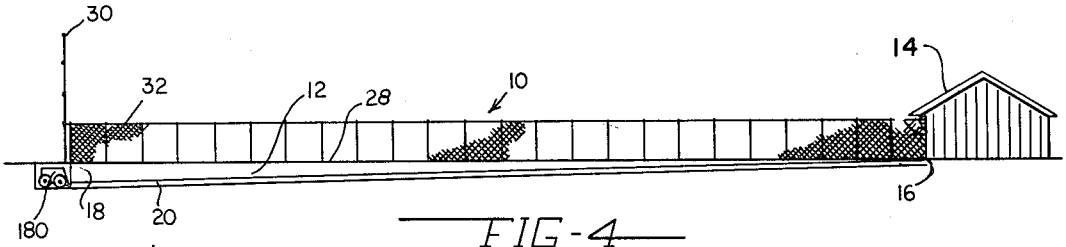
FIG. 4 is a sectional view of the driving range complex illustrated in FIGS. 1 through 3 taken substantially along section line 4—4 of FIG. 1.

Also shown in FIGS. 2 and 3 is the configuration of fairway 12. Fairway 12 slopes downwardly from the opposite longitudinal boundaries 26, 28 toward the alley 20. In addition, the fairway 12 also slopes downwardly from end 16 toward end 18. The slope in both directions is sufficient to cause balls landing on the surface of the fairway 12 to roll toward the alley 20 and collect in the alley 20 adjacent end 18, as shown in FIG. 5. Adjacent end 18 at the low point of the alley 20 there is provided a drain through which moisture as from rain, melting of snow and ice on the fairway 12 is discharged.

Figure 10:
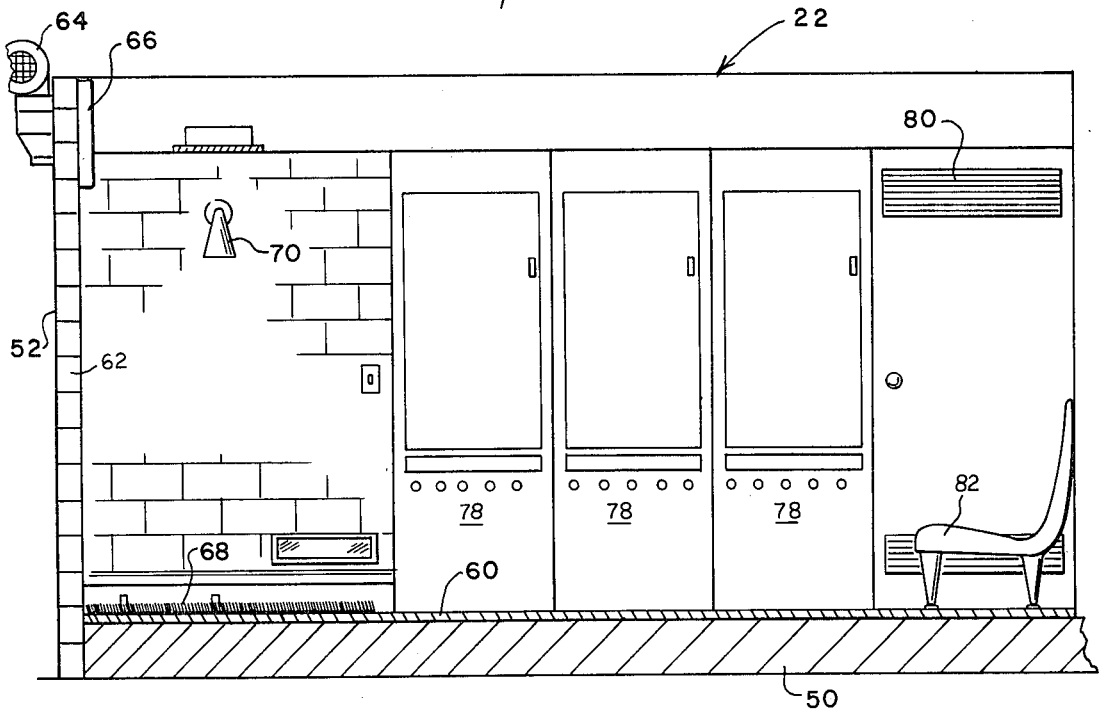
FIG. 10 is a fragmentary and sectional view of the driving booth illustrated in FIG. 9 taken substantially along the section line 10—10 of FIG. 9.
Figure 7:
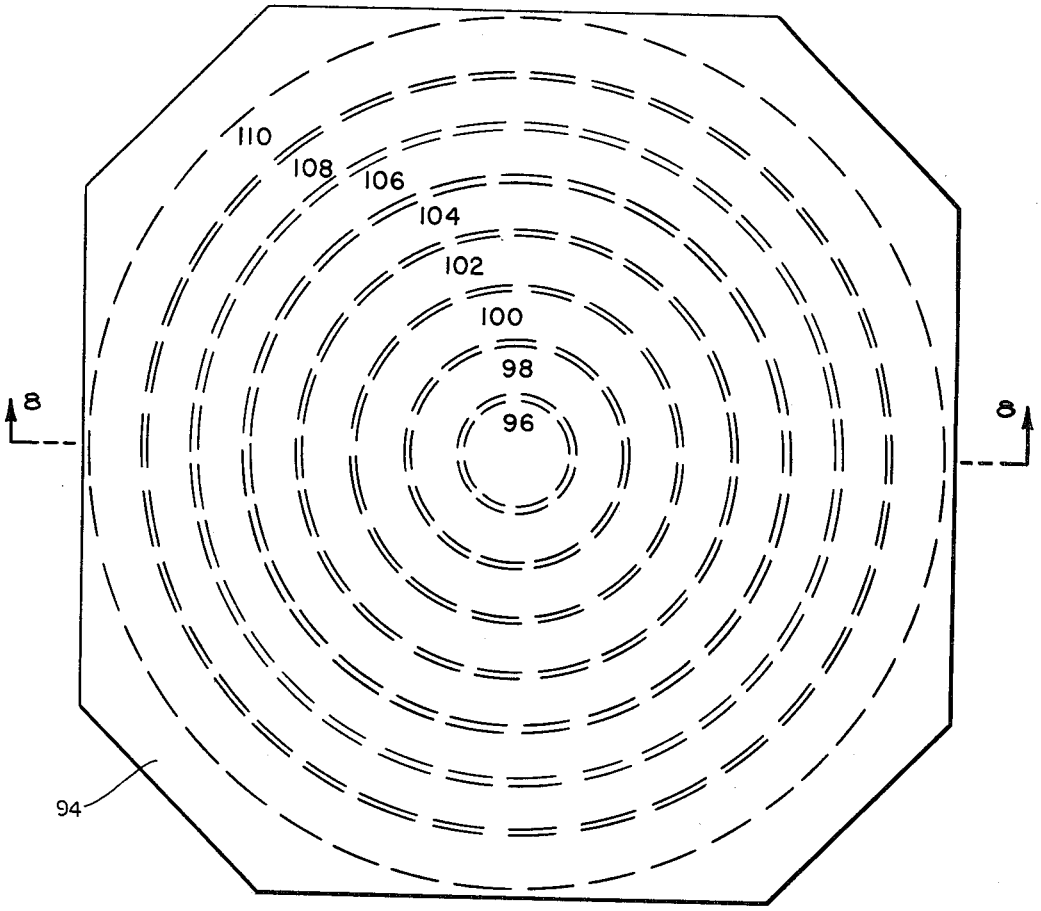
FIG. 7 is a top plan view of the target green of the invention.
Figure 9:
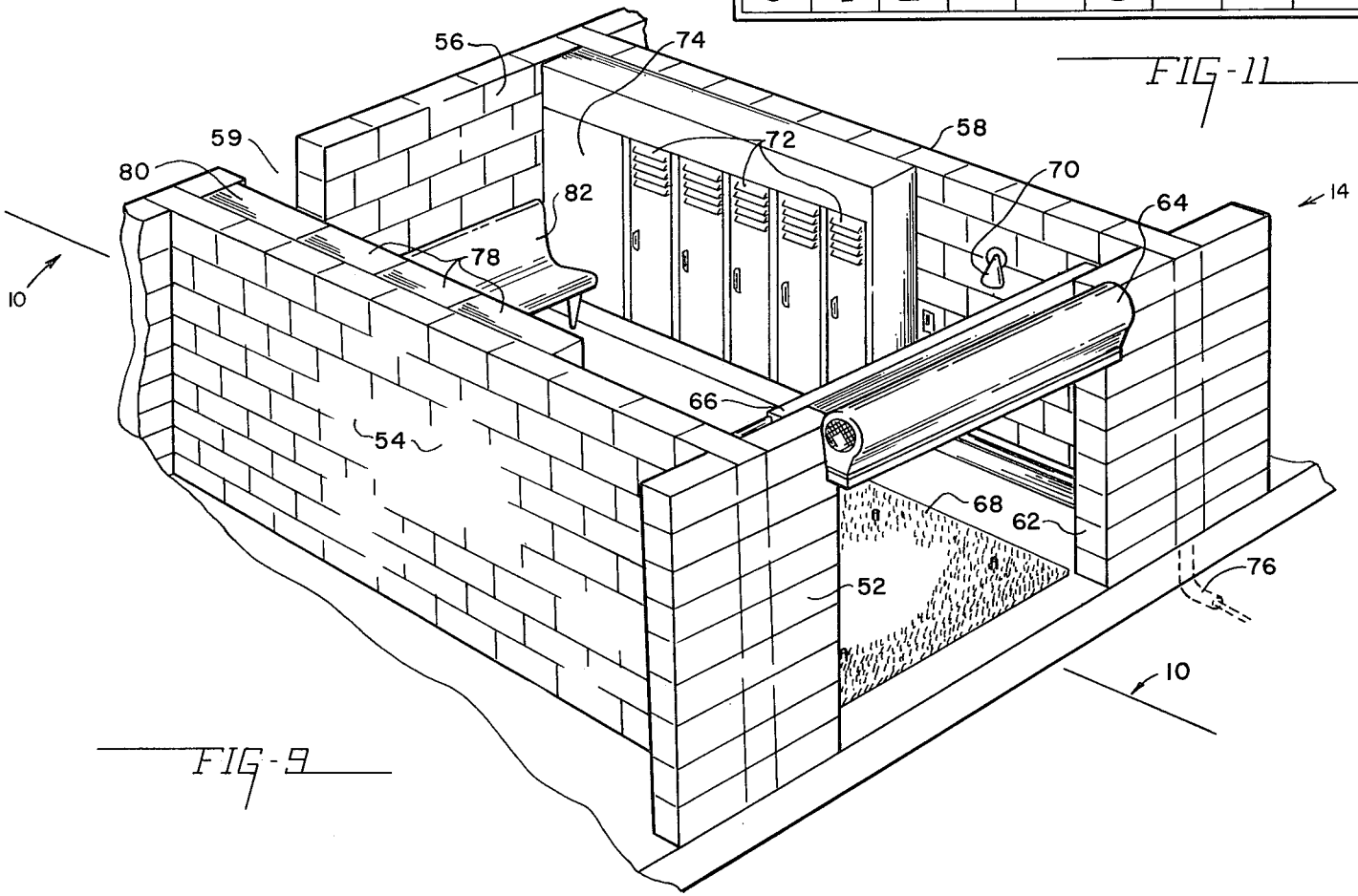
FIG. 9 is a perspective view showing one of the driving booths and the tee area of the driving range of the invention.

Now referring to FIGS. 9 and 10, the tee areas and booths 22 of the invention will now be described in detail. It should be understood however, that the driving range structure above-described is fully operable with conventional tees aligned in side by side fashion across the end 16 of the fairway 12.

Each of the booths 22 may be identical, thus, the description of one will suffice for all. Further, the booths 22 may be a part of a larger building such as the clubhouse 14 as shown in FIG. 1 or may be individual booths. Further, the booths may be temporary buildings such as a booth constructed on a mobile home or truck chassis or the like. By illustrating the booths in FIG. 9 as a fragmentary perspective view, it is to be understood that a plurality of booths in any event will be aligned in a side by side relationship so as to extend over the entire length of end 16 of the fairway 12 or over a portion thereof.

Booth 22 has a frame 50, upstanding walls 52, 54, 56 and 58, a roof (not shown) is supported by the walls of the booth so as to form an enclosure. Wall 56 has a doorway 59 therein to provide access to and from the booth. A suitable floor 60 is laid over the frame 50 and extends between the walls 52, 54, 56 and 58.

Figure 11:
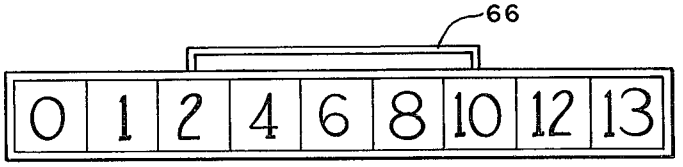
FIG. 11 is a plan view of the scoreboard which is mounted over the tee in the driving booth illustrated in FIGS. 9 and 10.

Wall 52 has an opening 62 therein. Opening 62 extends substantially between walls 54 and 58 and between the floor 60 and the roof. However, over the opening 62 on the exterior of wall 52 is mounted an air curtain 64. Air curtain 64 extends over the entire opening 62 and beyond the peripheral boundaries of opening 62 on the opposite sides thereof a small distance. Similarly positioned on the interior of wall 52 is a scoreboard 66. This scoreboard is illustrated in FIG. 11 and will be described hereinafter in more detail.

Adjacent to opening 62, an artificial tee 68 is positioned on the floor 60. Tee 68 again extends substantially across the entire opening 62 and rearwardly thereof a distance suitable to allow both right-handed golfers and left-handed golfers to properly address a golf ball positioned on the tee at a variety of locations. Lamps 70 are positioned on each of the walls 54 and 58 so as to illuminate the tee 68 at all times.

Rearwardly of the tee area adjacent wall 58 are positioned a plurality of lockers 72 and a storage area 74 in which is located the electronics associated with the scoreboard 66, the yardage indicator 44 previously described and illustrated in FIGS. 2 and 3, and the target greens of the invention. A fragment of the cable 76 is shown by which the electronics enclosed in the storage area 74 are connected to the target greens of the invention and the yardage indicator 44.

Adjacent wall 54 and directly opposite the lockers and the storage areas 72 and 74 are a plurality of vending machines 78. These vending machines are selected from conventional vending machines to vend beverages, foods, tobacco and the like such that persons using the driving range are provided with light snacks, lunches and the like. Directly opposite the storage area 74 is positioned a second storage area 80 containing the environmental control equipment. Both air conditioning, heating facilities and water and electrical utilities are located in storage area 80. Adjacent the rear wall 56 is provided a spectator's bench 82 which extends from the storage cabinet 74 to the door opening 59.

Referring now to FIG. 11, there is shown the scoreboard 6 mentioned hereinabove. This scoreboard is connected to the target green of the invention by means of the cable 76. The target green of the invention will be described in detail hereinafter. The scoreboard allows golfers to compete and to play a novel golf game. In playing this game, each player drives golf balls toward the target green of the invention. A score is indicated on the scoreboard 66 for each ball driven. The total of each of a player's balls will be added.

Now referring to FIGS. 6, 7, 8A, 8B, 8C and 8D, the target green 94 of the invention will now be described. As mentioned hereinabove relative to FIG. 1, one or more target greens of the invention are provided and positioned in one or more of the positions 24 illustrated in FIG. 1. However, it is to be understood that while the target green now to be described incorporates the invention, conventional artificial greens can be used with the driving range structure, if desired.

Figure 6:
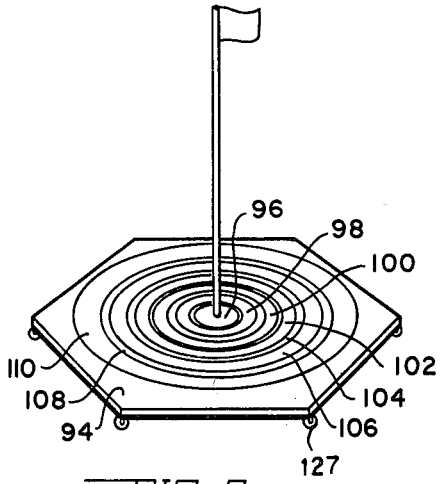
FIG. 6 is a perspective view of the target green of the invention.
Figure 8A:
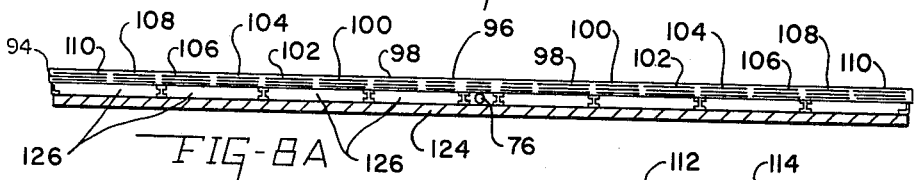
FIG. 8A is a sectional view of the target green illustrated in FIGS. 6 and 7 taken substantially along the section line 8—8 of FIG. 7 and showing the structure of the target green illustrated in FIGS. 6 and 7.

The target green 94 of the invention has a plurality of target zones including a bull's eye 96 and concentric annular target zones 98, 100, 102, 104, 106, 108 and 110. The target greens 94 may be positioned on a platform equipped with casters 127 as illustrated in FIGS. 6 and 8C or may be supported on a platform without casters as illustrated in FIG. 8A or the target green of FIGS. 8A and 8B may be used without any platform at all; in this latter construction the target green is in the form of a carpet which may be rolled up and stored when not in use. As can be seen most clearly in FIG. 7, each of the target zones are independent of each other and radially spaced apart.

Figure 8B:
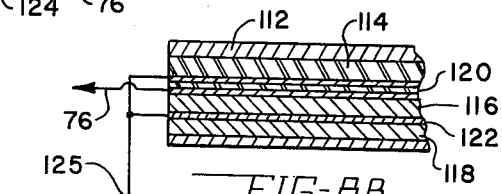
FIG. 8B is an enlarged framentary sectional view of the structure shown in FIG. 8A suggesting an alternate construction of the target of the invention.
Figure 8C:
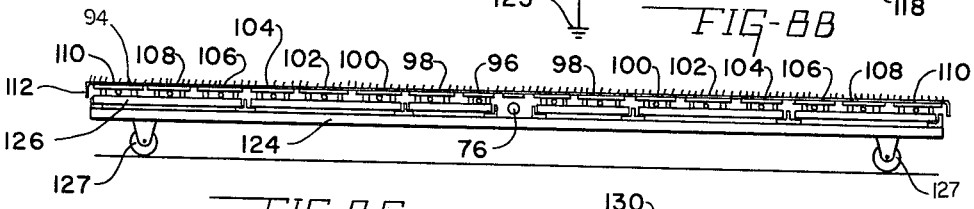
FIG. 8C is a sectional view like FIG. 8A showing another alternate construction of the target green of the invention.

As shown in FIGS. 8A and in the enlarged view thereof in FIG. 8B, each of the target zones may comprise a multi-layer construction having uppermost an all-weather covering 112. In a specific embodiment, this weather covering may be "astro turf" as manufactured and distributed by Monsanto Corp. Still referring to FIGS. 8A and 8B, each of the target zones fordescribed comprises an uppermost metallized rubber layer 114, an intermediate metallized rubber layer 116, and a bottommost metallized rubber layer 118. Metallized rubber layers 114 and 116 are separated and insulated from each other by insulating layer 120. Similarly, metallized rubber layers 116 and 118 are separated and insulated from each other by insulating layer 122. As shown in FIG. 8B, the uppermost metallized rubber layer 114 and the bottommost metallized rubber layer 118 are connected to ground 125. The middle metallized rubber layer 116 is connected by means of cable 76 to the electronics housed in storage cabinet 74 of the booths 22. The specific electronics are schematically illustrated in FIG. 13, and will be discussed hereinafter.

In the embodiment illustrated in FIG. 8A, each of the laminated target zones are supported on a frame 124. The laminates and the frame 124 are spaced apart by means of an insulating layer which in the specific embodiment illustrated takes the form of a plurality of blocks 126 of styrofoam. Shown also in FIG. 8A is cable 76 aforementioned. As mentioned above, frame 124 can be provided with casters. Also, as mentioned above, each of the laminate target zones can be completely encapsulated in molded rubber and the frame 124 eliminated. In this form, the target green appears like a large circular and rubberized carpet which can be rolled up and stored when desired. This carpet also can be placed upon a frame 124, with or without casters.

Figure 8D:
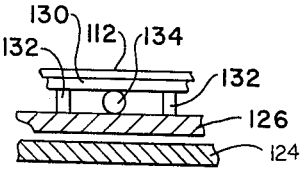
FIG. 8D is a fragmentary enlarged view of the structure shown in FIG. 8C.

Referring now to FIGS. 8C and 8D, a similar construction of target green 94 is illustrated. This form of target green is to be positioned on a frame 124, but the frame 124 can be with or without casters 127 as desired. In this embodiment, the target green 94 is also covered with a weather covering 112 and the various target zones are also separated from the frame 124 by insulating material 126. Each of the target zones comprise, as more clearly shown in FIG. 8D, metallic plates 130 supported in a spaced-apart relationship with insulating members 126 by means of supporting blocks 132. Affixed to each of the plates 130 is a pressure transducer 134 which may take the form of a microphone, strain gauge or the like.

Figure 13:
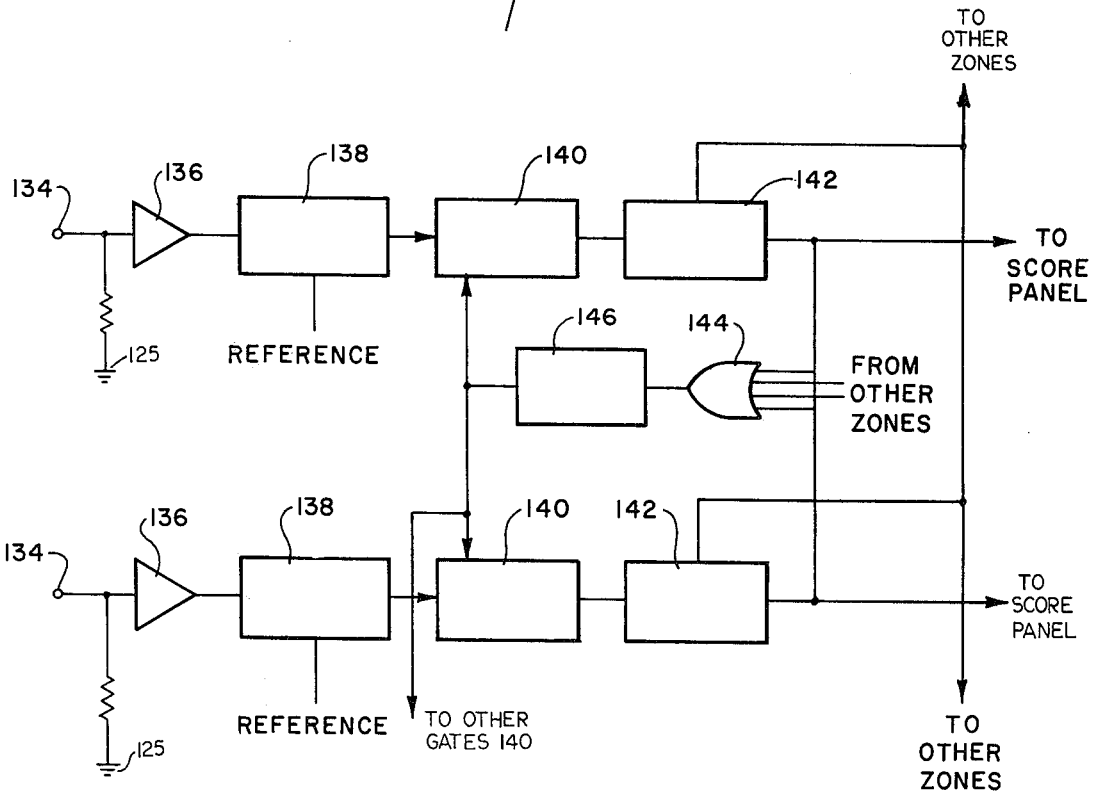
FIG. 13 is a schematic of the electronics associated with the target greens of the invention.

Referring now to FIG. 13, the electronics connected with the target greens of the invention will now be described in detail. As shown, each of the transducers 134 or in the alternative the middle metallized rubber layer 116 of each target zone is connected to an amplifier 136. Each of the amplifiers are connected to a signal level detector 138, each level detector having an adjustable reference point, as indicated, such that the level detector 138 will pass only signals from the target zones of a predetermined magnitude. All other signals are blocked. The level detectors are in turn connected to gates 140. Gates 140 are primarily electronic switches which are normally conductive. Gates 140 are connected to scoreboard drivers 142 which in turn are connected to the appropriate lighting devices of the scoreboard 66. Also, as shown, each of the scoreboard drivers 142 is connected to a gate 144 and a delay circuit 146. The dealy circuit 146 is connected to each of the gates 140. In a specific embodiment, each of the scoreboard drivers 142 may include a one shot multivibrator, or the like for a purpose to be explained below.

Figure 12:
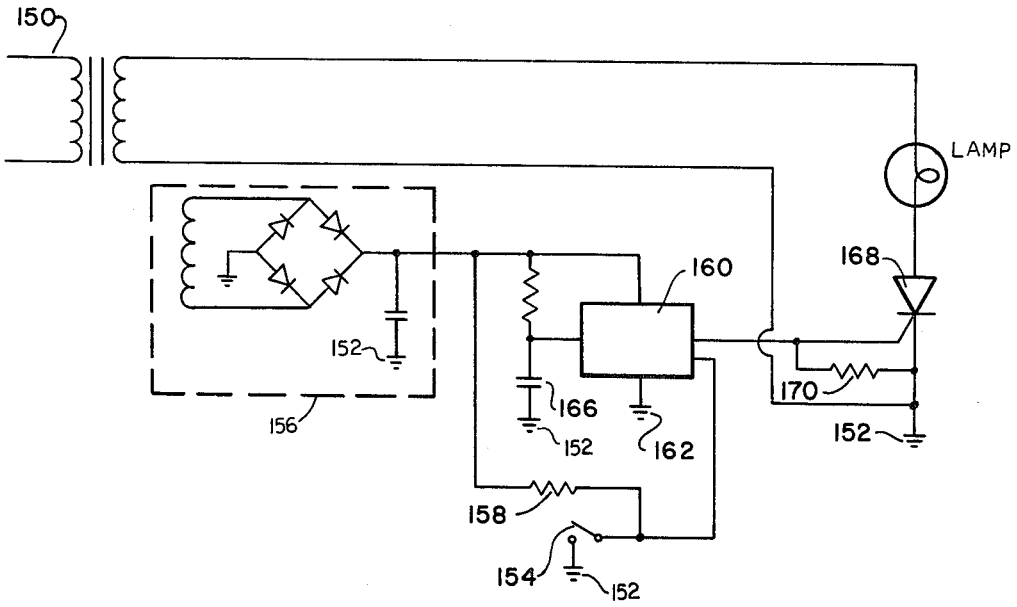
FIG. 12 is a schematic diagram of the electronics associated with the yardage indicator of the driving range of the invention.

Now referring to FIG. 12 the electronics connected between the screen portion 34, 36 and 38 and the yard indicator 44 will now be described in detail. In general, an alternating current power supply 150 is connected to ground 152 and to one side of a lamp in the yardage indicator 44. The microswitches 154 of each screen section 34*m* 36 and 38 are connected to a direct current power supply 156 by means of an appropriately sized resistor 158 and an integrated circuit in the form of a monostable multivibrator 160 similar to that above-described. The multivibrator 160 is connected between the power supply and ground 162 and between the power supply 156 and ground 152 by an appropriately sized resistor 164 and a capacitor 166. The multivibrator 160 in turn is connected to a switch 168 which is connected to ground 152. A resistor 170 is connected between the multivibrator 160 and ground 152, respectively.

In a specific embodiment the fairway 12 is 200 yards in length, the width of the fairway 12 at end 18 is about 200 yards, and the width of the fairway 12 at end 16 is about 100 yards. The slope of the fairway 12 both towards end 18 and towards the alley 20 is about 10 feet in 100 feet. The dimensions of the driving booths are about 10 feet by 9 feet by 11 feet and are equipped with either forced air heating or radient heating and air conditioning. The air curtain mounted over the opening 62 can be of the type manufactured by the King Company of Owatonna, Minn. or Miniveil Company of New Castle, Pa. Such air curtains not only provide a means for controlling environmental factors within booths such as heat and humidity, but also prevent insects and the like from entering the tee area via openings 62. The screens 30 and 32 may be of epoxy mesh material such as that sold by E. I. duPont deNemours Company of Wilmington, Delaware. Screen 32 is approximately 12 feet in height and screen 30 is approximately 35 feet in height. The three sections 34, 65 and 38 are respectively 8 feet, 8 feet, and 4 feet in height. The entire surface of the fairway is finely graded, compacted and overlaid with astro turf as sold by Monsanto Company.

The target greens 94, in a specific embodiment, are about 25 feet in diameter. Each of the annular target zones from 98 through 110 are substantially equal in thickness measured in a radial direction. In the construction illustrated in FIGS. 8C and 8D, the middle plates 130 are of 1/16 inch aluminum sheet, the insulating material 126 is a 2 inch styrofoam sheet, and the supporting bars 132 are aluminum and measure ½ inch square in cross-section. In the construction shown in FIGS. 8A and 8B, the insulating areas measure 1/32 of an inch and the conductive layers measure 1/16 of an inch, and the entire green structure as shown in FIG. 8B measures ¼ inch.

In a specific embodiment, a radio controlled cart 180 is provided to push the golf balls collecting in the alley 20 back toward the tee. This cart 180 may be a conventional four wheel or three wheel cart having a single speed having capability of going both forward and backward. The cart is provided with a plow 182 made of silicone rubber backed with aluminum and fixed at its leading edge. Plow 182 is generally complimentary with the shape of the alley 20. A compartment 184 is provided in which the cart 180 can be stored when not in use. Compartment 184 is located behind the screen 30 and underground. The bottom, the sides and the top of compartment 184 can be of concrete as can be the alley 20.

In operation the target of the invention can be used as a target green as disclosed above. Alternatively, with obvious modifications, the target can be used as an archery target, a fire-arm target, or the like. In each case, an impact upon any of the target zones of the target will produce a signal. Said signal will either be produced by the resonance of the plates 130 having the transducers 132 operably connected thereto or by the flexing of the layers 114 through 122. As this signal will be small, the signal is first amplified by amplifiers 136. The signal can then either be passed by the level detectors 138 or rejected. In the specific embodiment where the target is a target green, the level detectors are adjusted such that the impact of a golf ball initially on the green will be passed by the level detector but subsequent bounces of the golf ball on the green will generate signals of a magnitude that will not be passed by the level detector 138. If passed by the level detector 138, the signal is passed by the gate 140 so as to actuate the driver 142. The driver 142 remains actuated for a period of time determined by its internal circuitry. The signal from driver 142 is also applied via gate 144 to delay 146. The delay in turn applies, after a brief delay period, a signal to gates 140 rendering them non-conductive. This prevents further signals from passing through the system until driver 142 automatically turns off. After this preadjusted period of time has passed, the driver 142 turns off and the gate 140 becomes conductive such that the gate 140 will pass a subsequent signal. The scoreboard 66 to which the drivers 142 are connected, has a digital readout display. The display may, in a specific embodiment remain lighted until the scoreboard drivers change the display.

As mentioned above, the target structure is also useful as an archery target, a firearm target or the like. In such applications, the inhibitory circuitry may be eliminated in the level detector 138. Otherwise the structure will remain the same.

In operation, the target green of the invention and the remaining structure disclosed above is fully operable as an all-weather driving range. The booths 22 are equipped with lockers where golfers may store their personal belongings. Golfers may practice their golf shots or compete in the manner above-described both in winter and summer inasmuch as each of the booths are heated and air conditioned. Additionally, the air curtain 64 allows the opening 62 to remain open when the booth is in operation and to maintain the environment in the booth 22 in a heated or air conditioned state. Both right-handed and left-handed golfers may drive balls from the tee 68 through the opening 62 and onto the fairway 12. Balls which land anywhere on the fairway surface 12 will roll toward the alley 20 and be collected therein. Balls collected in the alley 20 will roll toward end 18. Once enough balls are collected in the alley 20, in the specific embodiment including the cart 180, cart 180 can be actuated to remove the balls from adjacent end 18 to adjacent end 16 where they can be collected and distributed once again to the booths 22.

The slope of the fairway 12 also allows rain and other moisture to collect in the alley 20 and to be discharged through the drain 46. When snow and ice collect on the fairway 12, the same can be removed by merely spreading salt on the fairway or spreading the same with salt water.

The screens 30 and 32 will prevent most balls driven from the various tees 68 to stay within the confines of the fairway 12. Calculations indicate that a drive must be well over 300 yards to clear a screen 20 feet high at end 18. As above-mentioned, screen 30 is 35 feet high. Thus it would appear that balls could clear screen 32 at lesser distances when the ball is sliced or hooked, otherwise the ball would remain within the confines of the screens 30 and 32. Then a ball strikes any of the screen sections 34, 36 and 38 the yardage indicator 44 will indicate, in the specific embodiment illustrated, either 300 yards, 250 yards or 200 yards. This is accomplished by connecting the microswitches of the screen sections to the yard indicator 44 by the electronics illustrated in FIG. 12. When the ball impacts any one of the screen sections, the microswitches supporting that screen will be closed. The closing of the switch will trigger the integrated circuit 160 which will produce a pulse. The duration of this pulse will be adjusted for the desired display time. The pulse will actuate the silicone controlled rectifier 168 to turn on the yardage indicator 44. After the pulse has lapsed, switch 168 will turn off the yardage indicator and the switch 168 will be reset for subsequent operation.

The game apparatus of the invention provides an entirely new concept in combination target-scoreboards and driving range structures meeting all of the objects of the invention. By the use of the invention, increased competition and thereby increased interest will be gained in all activities which heretofore have used targets. Additionally by the driving range structure of the invention, golfers may practice their golf shots and compete year round and in all weather, winter or summer.

While there have been described above the principles of this invention in connection with specific apparatus, it is to be clearly understood that this description is made only by way of example and not as a limitation to the scope of the invention.

What is claimed is:

1. A game apparatus of the driving range type comprising an elongated fairway, one end of said fairway being narrower than the other of said ends, a tee adjacent said one end, said fairway having a longitudinal axis, said fairway having a continuous and generally planar surface extending between said ends on both sides of said axis, said fairway surfaces sloping downwardly from said one end to said other end, said fairway surfaces also being sloped downwardly from the lateral edges thereof toward said axis, whereby balls striking said fairway surface will be urged to roll toward said axis and said other end.

2. The apparatus of claim 1 wherein said fairway further includes a ball-retrieving recess extending longitudinally thereof and downwardly from said fairway surfaces, said recess extending on opposite sides of said axis, said recess being sloped downwardly from said one to said other end of said fairway, whereby balls striking said fairway surface will be urged to roll toward said axis and said other end.

3. A game apparatus of the driving range type comprising an elongated fairway, one end of said fairway being narrower than the other of said ends, a tee adjacent said one end, said fairway having a continuous surface extending between said ends, said fairway surface sloping downwardly from said one to said other end, said fairway having a longitudinal axis, said fairway surface also being sloped downwardly from the lateral edges thereof toward said axis, whereby balls striking said fairway surface will be urged to roll toward said axis and said other end, a target fence extending transversely of said fairway adjacent said other end thereof and in a generally perpendicular plane, said target fence including a plurality of target sections, said target sections being serially disposed in vertical relationship, each of said target sections corresponding to different driven yardage of a ball, and further including a plurality of electrical impact sensing means individually coupled to different ones of said target sections for generating electrical signals in response to a ball impacting thereon, and means for visibly registering the impact of said ball on different ones of said sections.

4. The apparatus of claim 3 further comprising a booth at said one end of said fairway, said booth having a floor, ceiling, and walls, one of said walls having an opening therein, there being a tee mounted within said booth adjacent said opening, the dimensions of said booth and said opening being sufficient to allow a ball to be driven from said tee and within said booth.

5. The apparatus of claim 3 wherein said electrical impact sensing means includes a plurality of impact responsive signal generators connected to each of said target sections, and a signal selector circuit operatively connected to said signal generators, and wherein said registering means includes a plurality of scoreboard drivers operatively connected to said selector circuit and each of said target zones.

6. The apparatus of claim 5 wherein said signal selector circuit includes a signal generating circuit for generating a disabling signal for a predetermined period of time.

7. The apparatus of claim 6 wherein said fairway further includes a ball-retrieving recess extending longitudinally thereof and downwardly from said fairway surface, said recess extending on opposite sides of said axis, said recess being sloped downwardly from said one to said other end of said fairway.

8. The apparatus of claim 7 further comprising a booth at said one end of said fairway, said booth having a floor, ceiling, and walls, one of said walls having an opening therein, there being a tee mounted within said booth adjacent said opening, the dimensions of said booth and said opening being sufficient to allow a ball to be driven from said tee and within said booth.

* * * * *